US008435934B2

(12) United States Patent
Papari et al.

(10) Patent No.: US 8,435,934 B2
(45) Date of Patent: May 7, 2013

(54) HYDROGEN PEROXIDE BASED CLEANING, SANITIZING, DEODORIZING AND SCALE INHIBITING SOLUTION

(75) Inventors: Joanne Papari, Toronto (CA); Hao Li, Etobicoke (CA)

(73) Assignee: Biochem Environmental Solutions, Inc., Ontario (CA)

( * ) Notice: Subject to any disclaimer, the term of this patent is extended or adjusted under 35 U.S.C. 154(b) by 174 days.

(21) Appl. No.: 12/817,098

(22) Filed: Jun. 16, 2010

(65) Prior Publication Data

US 2010/0331227 A1 Dec. 30, 2010

(30) Foreign Application Priority Data

Jun. 30, 2009 (CA) ..... 2670820

(51) Int. Cl.
*C11D 1/75* (2006.01)

(52) U.S. Cl.
USPC ..... 510/191

(58) Field of Classification Search ..... 510/191
See application file for complete search history.

(56) References Cited

U.S. PATENT DOCUMENTS

| | | | | |
|---|---|---|---|---|
| 5,611,088 | A | 3/1997 | Almon | |
| 6,346,279 | B1 | 2/2002 | Rochon | |
| 6,387,321 | B1 | 5/2002 | McGill | |
| 6,399,557 | B2 * | 6/2002 | Perkins et al. | 510/310 |
| 7,169,237 | B2 * | 1/2007 | Wang et al. | 134/42 |
| 2005/0058719 | A1 * | 3/2005 | Ramirez et al. | 424/616 |
| 2008/0009549 | A1 * | 1/2008 | Kawakami et al. | 514/714 |

* cited by examiner

*Primary Examiner* — John Hardee
(74) *Attorney, Agent, or Firm* — Klarquist Sparkman, LLP

(57) ABSTRACT

An environmentally friendly hydrogen peroxide cleaning and sanitizing solution is disclosed that may be used for cleaning, deodorizing, sanitizing and scale inhibiting in toilets and urinals in washroom and toilet areas. The solution also has the added benefit of eliminating odors and reducing corrosion in the washroom plumbing. The present cleaning and sanitizing solution consists of distilled water, hydrogen peroxide, a surfactant, a hydrogen peroxide stabilizer, a chelating agent, and corrosion inhibitors. The pH of the cleaning and sanitizing solution is greater than 6.0, and typically about 6.0 to about 8.0. The present cleaning, sanitizing, deodorizing and scale inhibiting solution is distributed to the washroom fixtures by means of refillable pump systems commonly known in the art.

6 Claims, 2 Drawing Sheets

HYDROGEN PEROXIDE BASED CLEANING, SANITIZING, DEODORIZING AND SCALE INHIBITING SOLUTION

CROSS REFERENCE TO RELATED APPLICATION

This application claims priority from Canada Application No. 2,670,820, filed Jun. 30, 2009, which application is incorporated herein by reference in its entirety.

FIELD

This invention relates to the field of sanitation in washroom and toilet areas. More specifically, this invention relates to an environmentally friendly toilet cleaning and sanitizing solution that also has the further advantages of de-scaling mineral deposits and deodorizing the washroom and toilet.

BACKGROUND

The sanitation industry typically employs one of several types of solutions for cleaning and sanitizing washrooms and toilet areas. These solutions include: a quaternary ammonium salt-based formula (typically referred to as 'Quats'); a sodium hypochlorite based formulation (typically referred to as 'bleach'), acidic cleaners; caustic or basic cleaners; and, hydrogen peroxide-based formulas.

The most common types of solutions for washroom cleaning and sanitizing are Quats, which are effective and widely used. However, these formulations are quite toxic and can adversely affect the bacteria used in modern water treatment systems.

There are various hydrogen peroxide-based cleaning solutions for sanitizing and controlling odour in washrooms and toilet areas, such as described in U.S. Pat. No. 5,611,088 to Almon. Almon discloses a sanitary system where an electro cell is mounted in the toilet tank reservoir, which causes a portion of the water in the reservoir to be converted to hydrogen peroxide. The hydrogen peroxide is then introduced to the toilet bowl where it deodorizes and sanitizes all exposed surfaces. However, Almon requires that the toilet being sanitized has a reservoir where the electrode can be mounted, and this is not the case for all toilets and urinals. In addition, hydrogen peroxide works as a sanitizer but is not a cleaner.

U.S. Pat. No. 6,346,279 to Rochon discloses a hydrogen peroxide solution with a pH of between 1 and 3, which is used in conjunction with a phosphorus-based acid. This method is effective, however, the low pH of the solution can cause severe corrosion in the washroom plumbing and phosphoros acid compounds can be somewhat harmful to the environment.

U.S. Pat. No. 6,387,321 to McGill discloses a hydrogen peroxide solution used in conjunction with a sodium hypochlorite compound for controlling toilet odour. As with the other hydrogen peroxide based solutions, this is effective for sanitizing washrooms, however, sodium hypochlorite, commonly known as bleach, is a harsh chemical and is not environmentally friendly.

U.S. Pat. No. 7,169,237 to Wang, et al., discloses a formulation using a catalyzed phosphoric acid and a stannate stabilizer. The inherent problems with this cleaning solution are that it puts phosphoric acid into the environment, which can acidify soils and contribute to water pollution, and it exacerbates corrosion problems in washroom plumbing, which is an issue for all acidic cleaning solutions.

Accordingly, there is a need for a washroom cleaning and sanitizing solution that works with all types of toilets and urinals, is environmentally friendly, inhibits corrosion in washroom plumbing, and has pH of 7-9.

The solution detailed in this application was a significant challenge for the applicant because of the unusual and contradicting factors that had to be considered when developing an effective hydrogen peroxide solution that cleans, sanitizes, deodorizes and limits the formation of mineral scale. It is well known that:

- Iron and copper are decomposition catalysts for hydrogen peroxide;
- Both nitrogen-based (such as EDTA or ethylenediaminetetraacetic acid) and phosphorus-based (such as phosphoric acid) chelating agents have more affinity to copper than calcium or magnesium. This means that chelation is necessary for hydrogen peroxide stability but is corrosive to copper and brass. In the presence of copper, chelating agents tend to react with copper and not work as a scale inhibitor;
- Unlike metals such as aluminum, copper oxide does not form a strong copper oxide film on the interior pipe walls that would protect the rest of the copper plumbing from corrosion;
- Hydrogen peroxide is more stable at higher concentration and even when it is diluted with water of the highest purity, it is less stable than the concentrated product; and
- Hydrogen peroxide is more stable at a pH below 4-4.5 without stabilizers.

It is therefore quite a challenge to make a cleaning and sanitizing solution that has 0.5%-5% hydrogen peroxide, that is neutral (pH of 7-9), that is stable during storage and that is non-corrosive to brass and copper pipes.

SUMMARY

The disclosure herein describes a washroom cleaning, sanitizing, deodorizing and scale-inhibiting solution comprised of distilled water, hydrogen peroxide, an amine oxide surfactant, hydrogen peroxide stabilizer, a chelating and sequestering agent and a corrosion inhibitor.

The applicant approached the inter-related problem of stability and corrosiveness mentioned above as two separate problems in developing the cleaning, sanitizing and deodorizing solution described herein. On one hand, the stability of the hydrogen peroxide was improved using chelating agents such as diethylenetriamine penta(methylene phosphonic acid) (also known as DTPMPA) and a hydrogen peroxide stabilizer such as a sodium stannate/phosphoric acid blend reagent. On the other hand corrosion inhibitors such as one or a combination of corrosion inhibitors selected from the group consisting of sodium molybdate, sodium lauryl sarcosinate, and triazoles such as sodium tolyltriazole are used to form a stable coating on the brass or copper pipes to prevent and minimize the contact between the stabilized hydrogen peroxide and the brass or copper plumbing.

The cleaning, sanitizing, deodorizing and scale inhibiting solution described herein by the applicant is for one step cleaning and sanitizing of the surfaces. Compared to regular cleaners, it has a further advantage of reducing odours by killing or inhibiting the growth of bacteria that cause unpleasant odours. The hydrogen peroxide based solution disclosed herein by the applicant is a much more environmentally friendly alternative to the quaternary ammonium-based solutions that are typically used for these purposes. Hydrogen peroxide is completely biodegradable, as it naturally breaks down over time into water and oxygen byproducts.

DTPMPA acts as a chelating agent in the washroom plumbing, as it is a good mineral scale inhibitor. Chelation refers to a chemical process whereby metal ions bind with the chelating agent at the agent's active sites. This eliminates the available free metal ions and effectively prevents hard water precipitate build-ups within the washroom plumbing.

The amine oxide surfactant not only acts as a surfactant but is also used to reduce surface tension and facilitate the distribution of the applicant's sanitizing solution on the surfaces that it contacts. Surfactants are commonly used as wetting agents, which decrease the surface tension of a liquid, thereby increasing the wettability of the contact surface. As a result, the applicant's sanitizing solution distributes much more uniformly over the washroom surfaces.

A corrosion inhibitor is used to further minimize the risk of harmful corrosion within the washroom plumbing. In the present application, the applicant uses one or a combination of corrosion inhibitors selected from the group consisting of sodium molybdate, sodium lauryl sarcosinate, and triazoles such as sodium tolyltriazole. These corrosion inhibitors form a monomolecular layer on the surface of metal parts such as pipes, made of, for example, brass, copper or iron, and prevent the contact of such metals with any oxidizer. This thin molecular layer coating plays an essential part in preventing corrosion and over time gradually forms on the entire internal surface of the pipe. As each of sodium molybdate, sodium lauryl sarcosinate and triazoles such as sodium tolyltriazole have slightly different effects, it is contemplated that one or a combination of the afore-mentioned corrosion inhibitors could be used to suit the plumbing construction, water chemistry, fixture selection or other such features of a particular installation.

The applicant's sanitizing solution is used in a typical washroom environment by introducing it to a source of fresh water via a one way ball valve leading to an orifice nozzle positioned mid stream in the fresh water piping as illustrated in FIGS. 1 and 2 for a toilet or a urinal, respectively. In the alternative, the sanitizing solution may be introduced into a water reservoir where such reservoirs are provided for the washroom fixtures. The solution may be dispensed using a reusable and refillable dispenser pump, commonly known in the industry.

In accordance with one aspect of the applicant's cleaning, sanitizing, deodorizing and scale inhibiting solution, there is provided a cleaning and sanitizing composition comprising: a) about 90 wt % to about 99 wt % of distilled water; b) about 0.5 wt % to about 5 wt % of hydrogen peroxide; c) about 0.1 wt % to about 1.5 wt % of amine oxide surfactant; d) about 10 ppm by weight to about 0.5 wt % of stannate stabilizer; e) about 10 ppm by weight to about 0.5 wt % of a chelating agent; and f) a corrosion inhibitor; and the composition has a pH greater than 6.0.

In accordance with another aspect, there is provided a method of cleaning and sanitizing a urinal, the method comprising the steps of introducing a composition to the water stream supplying the urinal, the composition comprising: a) about 90 wt % to about 99 wt % of distilled water; b) about 0.5 wt % to about 5 wt % of hydrogen peroxide; c) about 0.1 wt % to about 1.5 wt % of amine oxide surfactant; d) about 10 ppm by weight to about 0.5 wt % of stannate stabilizer; e) about 10 ppm by weight to about 0.5 wt % of a chelating agent; and f) a corrosion inhibitor; and the composition has a pH greater than 6.0.

In accordance with a further aspect, there is provided a method of cleaning and sanitizing a toilet, the method comprising the steps of introducing a composition to the water stream supplying the toilet, the composition comprising: a) about 90 wt % to about 99 wt % of distilled water; b) about 0.5 wt % to about 5 wt % of hydrogen peroxide; c) about 0.1 wt % to about 1.5 wt % of amine oxide surfactant; d) about 10 ppm by weight to about 0.5 wt % of stannate stabilizer; e) about 10 ppm by weight to about 0.5 wt % of a chelating agent; and f) a corrosion inhibitor; and the composition has a pH greater than 6.0.

In accordance with yet another aspect, there is provided a method of preparing a hydrogen peroxide composition, the method comprising the steps of preparing a solution by mixing: a) about 90 wt % to about 99 wt % of distilled water; b) about 0.5 wt % to about 5 wt % of hydrogen peroxide; c) about 0.1 wt % to about 1.5 wt % of amine oxide surfactant; d) about 10 ppm by weight to about 0.5 wt % of stannate stabilizer; e) about 10 ppm by weight to about 0.5 wt % of a chelating agent; and f) a corrosion inhibitor; and the composition has a pH greater than 6.0.

It is to be understood that other aspects of the present cleaning, sanitizing, deodorizing and scale inhibiting solution will become readily apparent to those skilled in the art from the following detailed description, wherein various embodiments are shown and described by way of illustration. As will be realized, the cleaning, sanitizing, deodorizing and scale inhibiting solution is capable of other and different embodiments and its several details are capable of modification in various other respects, all without departing from the spirit and scope of the cleaning and sanitizing solution described. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the applicant's cleaning, sanitizing, deodorizing and scale inhibiting solution are illustrated by way of example, and not by way of limitation, in detail, wherein.

DETAILED DESCRIPTION

Figure 1:
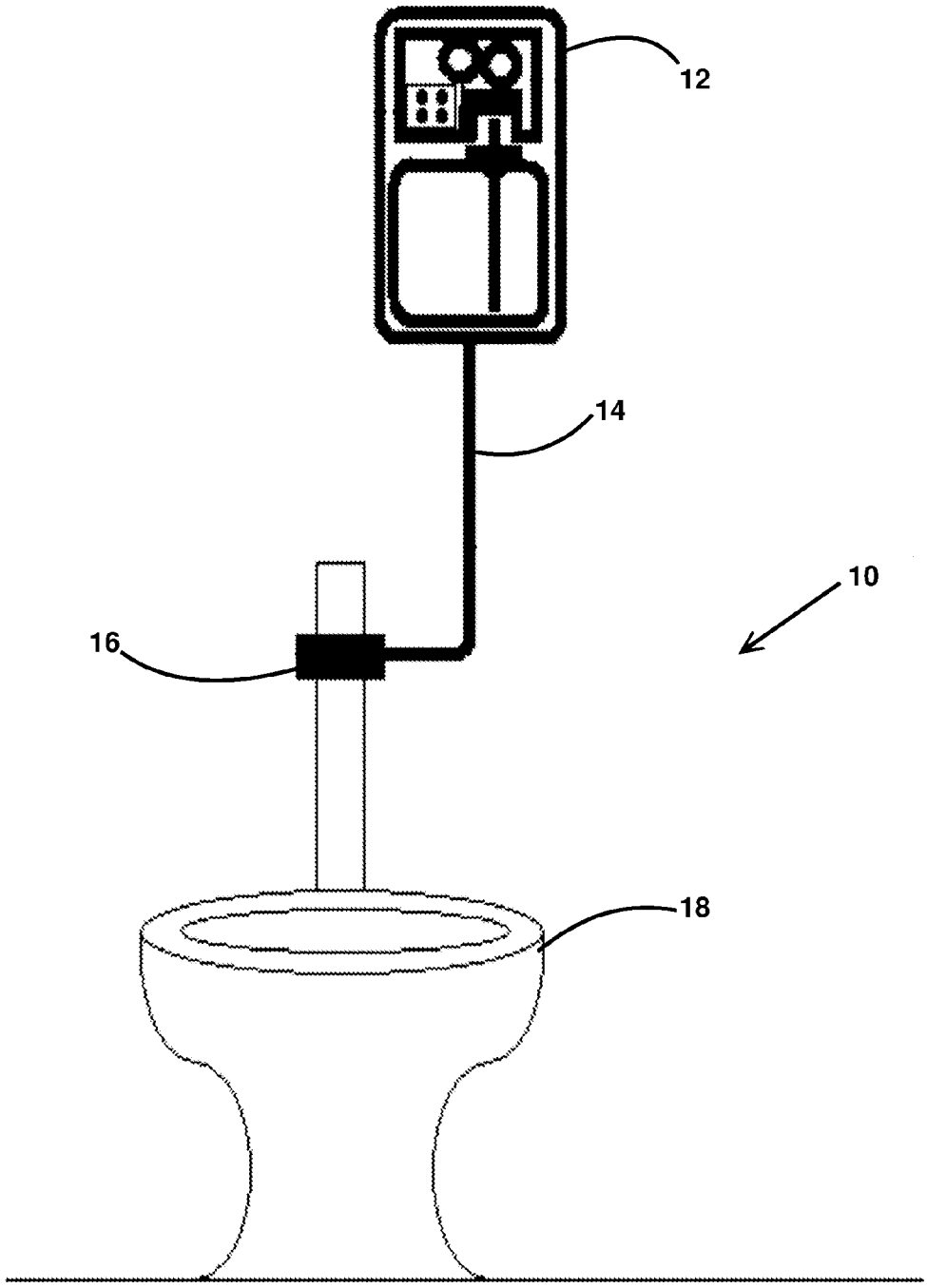
FIG. 1 is a diagram of a distribution system for the present cleaning, sanitizing, deodorizing and scale inhibiting solution configured for a toilet.

The applicant's cleaning, sanitizing, deodorizing and scale inhibiting solution will now be described with reference to specific embodiments, wherein similar numerals are used to identify similar elements.

The applicant's cleaning, sanitizing, deodorizing and scale inhibiting solution is an aqueous hydrogen peroxide composition comprising distilled water, hydrogen peroxide, an amine oxide surfactant, a hydrogen peroxide stabilizer such as a sodium stannate/phosphoric acid blend, a chelating and sequestering agent such as DTPMPA and a corrosion inhibitor such as one or a combination of corrosion inhibitors selected from the group consisting of sodium molybdate, sodium lauryl sarcosinate, and triazoles such as sodium tolyltriazole.

As noted, the solution is comprised of the following compounds which are now described in further detail:

Distilled water: For the stability of hydrogen peroxide, the purity of the solvent water is of the utmost importance. In particular, a very low concentration of transition metals such as copper and iron is critical. These metals act as a catalyst for the decomposition of hydrogen peroxide. However the term water in this application in general refers to all kind of water, including but not limited to distilled water, de-ionized water, de-mineralized water, soft water, tap water and all other kinds of water.

Hydrogen peroxide: Hydrogen peroxide is known to be a strong oxidizer. The oxidizing property is useful in two ways as it reduces bacterial and viral populations by destroying bacterial and viral cell membranes, and it also removes stains in a washroom fixture such as a toilet bowl or urinal. The non-discriminating and non-selective oxidation of hydrogen peroxide prevents formation of resistant bacteria and viruses. Furthermore, hydrogen peroxide has excellent biodegradability and produces no hazardous byproducts.

Amine oxide surfactant: Amine oxide surfactants such as but not limited to lauramine oxide are known for their stability in hydrogen peroxide solutions and are available in various chain lengths of the alkyl group. A surfactant has two functions in the applicant's formulation as described herein. First, as a wetting agent it helps to decrease the surface tension of the liquid, thereby increasing the wettability of the contact surface. Second, as a surfactant it functions to prevent organic matter from precipitating out of solution and depositing on washroom surfaces and keeps them soluble, thereby preventing deposition back on surfaces. This helps keep the toilet and urinals cleaner for a longer time.

Hydrogen peroxide stabilizers: It is known that hydrogen peroxide is more stable at higher concentrations. When a concentrated hydrogen peroxide solution is diluted to 0.5 to 5% hydrogen peroxide, even with highly pure water, the hydrogen peroxide component becomes less stable. For this reason hydrogen peroxide stabilizers are added. Stannate [SnO32- or Sn(OH)6]2- is known as a hydrogen peroxide stabilizer, however it is critical to choose the right pH range. If the pH level is too high, it can destabilize the hydrogen peroxide solution and at too low a pH level the stannate will precipitate out of solution. For pH adjustment of the stannate reagent, phosphoric acid is used, however other acids could be used as well. A pH range of 9-10 for the stannate oxide reagent was selected. The pH of the resulting final solution is preferably in the neutral range and preferably in the range of 7-9. Stannate ions can come from sodium stannate (Na2SnO3) potassium stannate (K2Sn(OH)6) or any other suitable source. Stabilizers are added to the concentrated hydrogen peroxide solution before dilution with distilled water.

Chelating agents: Such as diethylenetriamine penta(methylene phosphonic acid) (also known as DTPMPA) can further stabilize hydrogen peroxide through chelation of any remaining heavy metal ions in the solution or from any other raw materials present in the application environment. Hard water mineral deposits that build up inside pipes is a common problem in all modern plumbing systems, including public washrooms. DTPMPA is a good scale inhibitor. It is contemplated that the use of phosphonates in the applicant's solution includes but is not limited to DTPMPA as a chelating agent.

Corrosion inhibitors: It is contemplated that one or a combination of corrosion inhibitors selected from the group consisting of sodium molybdate, sodium lauryl sarcosinate, and triazoles such as sodium tolyltriazole could be used in the applicant's cleaning, sanitizing, deodorizing and scale inhibiting solution. The applicant's solution can contain one, two or all of these chemicals in varying proportions as required. Also the use of triazoles is not limited to sodium tolyltriazole and can be from any type of triazole known in the art, including but not limited to benzotriazole, mercaptobenzotriazole, butylbenzotriazole, and/or hydrogenated tolyltriazole, all of which may be used.

Highly acidic or caustic toilet and urinal cleaners are favored because of their good cleaning properties and because they save time. However, their use makes no consideration for the long-term effect they have on pipes and on the environment, as these cleaners are highly corrosive. The applicant's addition of anticorrosion chemicals prevents corrosion due to the highly oxidative hydrogen peroxide. Additionally, over time, use of such corrosion inhibitors creates a strong coating inside the drainpipes, preventing the formation of further oxidation.

The cleaning, sanitizing, deodorizing and scale inhibiting solution described herein by the applicant comprises the previously described components mixed in the following proportions:

- distilled water at about 90 wt % to about 99 wt %;
- hydrogen peroxide at about 0.5 wt % to about 5 wt %;
- amine oxide surfactant at about 0.1 wt % to about 1.5 wt %;
- a stannate stabilizer such as hydrated sodium stannate ($Na_2SnO_3.3H_2O$) at about 10 ppm by weight to about 0.5 wt %;
- about 10 ppm by weight to about 0.5 wt % of a chelating agent such as DTPMPA; and
- a corrosion inhibitor comprising one or a combination of about 10 ppm by weight to about 0.5 wt % of sodium molybdate and/or about 0.05 wt % to about 0.2 wt % of sodium lauryl sarcosinate, and/or about 10 ppm by weight to about 0.5 wt % of triazole such as tolyl triazole.

The pH of the applicant's cleaning and sanitizing solution is selected to be greater than 6.0, and typically about 7.0 to about 9.0.

The pH level is an important factor in making and storing sodium stannate solution, since under the wrong pH conditions stannate can precipitate out of solution. The applicant tested different concentrations of the stannate reagent and different amounts of stannate in the final cleaning solution. It is important to prepare the stannate solution separately. The pH of the stannate reagent by itself was found to be most stable at pH 9-10. Depending upon the concentration of other chemicals 10 to 5000 ppm by weight of stannate in the form of hydrated sodium stannate ($Na_2SnO_3.3H_2O$) can be used under a final product pH of 7-9. For pH adjustment of the stannate reagent, phosphoric acid is the preferred acid. The pH of final formula is in the neutral range and preferably in the range of 7-9.

The individual components comprising the present invention are known and readily available. Specifically:

- Hydrogen peroxide is readily available in concentrations of 3% to 70%;
- Amine oxide surfactant is available in various chain lengths of the alkyl group;
- Stannate reagent is available in the form of sodium or potassium stannate;
- Diethylenetriamine penta(methylene phosphonic acid) is commonly available in solutions at about 50 wt %;
- Sodium molybdate is available in powder form;
- Sodium lauryl sarcosinate is available in liquid form;
- Triazoles such as sodium tolyltriazole are available in liquid or powder form.

Although tolyltriazole is the preferred triazole used in the present invention, it is contemplated that any other triazoles including but not limited to benzotriazole, mercaptobenzotriazole, butylbenzotriazole, and/or hydrogenated tolyltriazole can be used. Similarly, it is not contemplated that the use of phosphonates be limited to diethylenetriamine penta(methylene phosphonic acid) (DTPMPA).

EXAMPLES

The advantageous properties of the applicant's cleaning and sanitizing solution can be observed by reference to the following examples, which illustrate but do not limit the invention.

It was a challenge to make a cleaning and sanitizing solution that has 0.5%-5% hydrogen peroxide that is neutral (pH of 7-9), stable during storage and non-corrosive to brass and copper pipes. The following are examples of various samples that were made and tested for corrosiveness against copper and for hydrogen peroxide stability.

The following simple tests have been established by the applicant for determining levels of corrosion and hydrogen peroxide stability:

Presence of Corrosion: When a solution of stabilized hydrogen peroxide in contact with a brass pipe turns blue, it indicates that the chelating agent in the solution is dissolving the brass or copper and therefore the pipe, over time, will lose it strength.

Stability of Hydrogen Peroxide: Decomposition of hydrogen peroxide during storage forms oxygen and water. The pressure in the bottle was used as an indication of whether the hydrogen peroxide was decomposing and, over time, the active peroxide concentration being reduced. By varying the amount of overhead pressure in the plastic bottle, even very minute amounts of oxygen can be detected.

Example two illustrates a cleaning and sanitizing solution that is stable and non-corrosive to copper and brass and is comprised of hydrogen peroxide, surfactant, chelating agent, and stabilizer and corrosion inhibitor.

Figure 2:
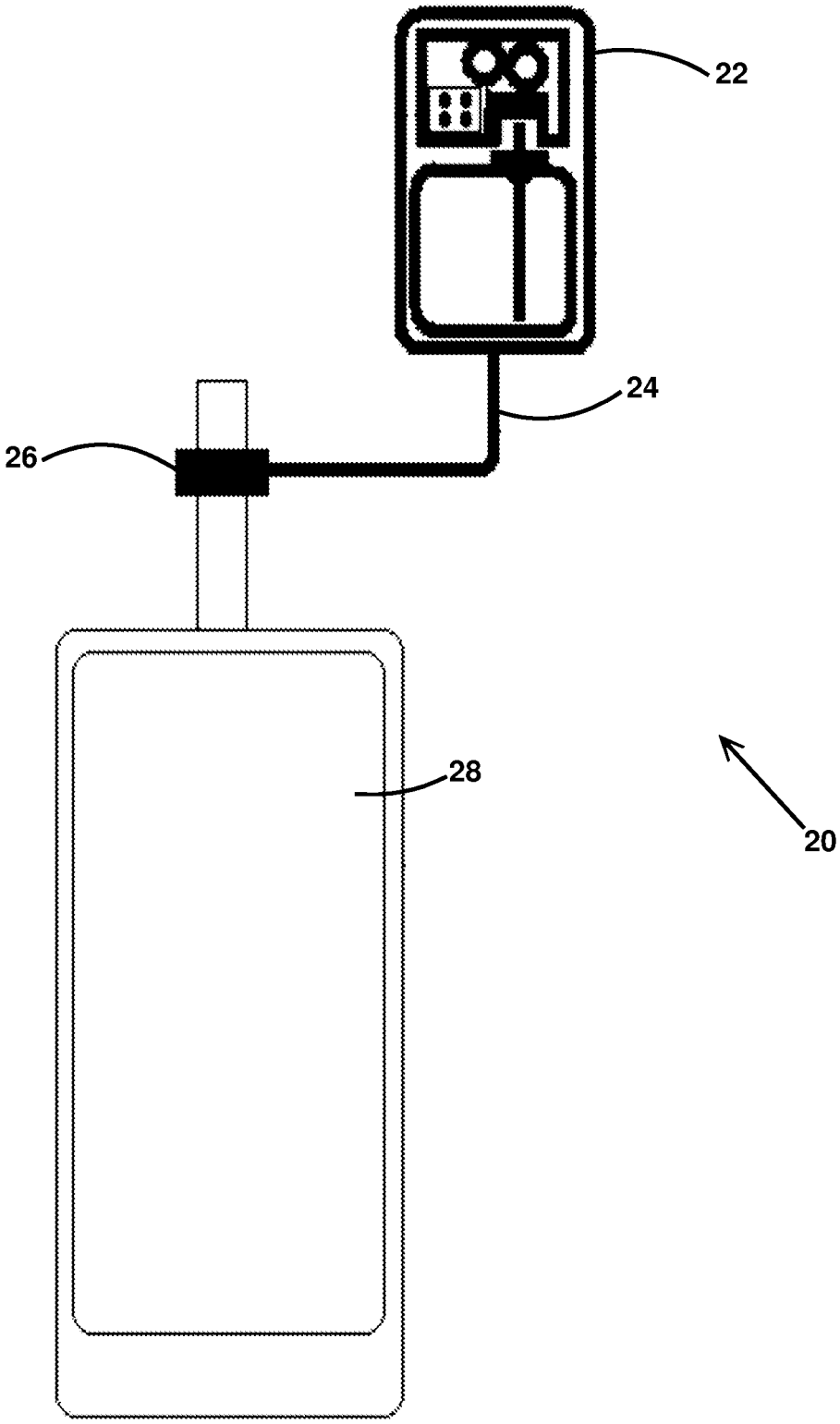
FIG. 2 is a diagram of a distribution system for the present cleaning, sanitizing, deodorizing and scale inhibiting solution configured for a urinal.

Referring to FIGS. 1 and 2, as previously mentioned, the applicant's cleaning, sanitizing, deodorizing and scale inhibiting solution is used in a typical washroom environment as illustrated in FIGS. 1 and 2 for a toilet system 10 or a urinal system 20, respectively. The applicant's solution flows from a dispenser 12, 22 to a source of fresh water via plastic or metal tubing 14, 24 to a one way ball valve 16, 26 leading to an orifice nozzle positioned mid stream in the fresh water piping leading to a toilet 18 or urinal 28. In the alternative, the sanitizing solution may be introduced into a water reservoir where such reservoirs are provided for the washroom fixtures. The solution may be dispensed using reusable and refillable dispenser pumps 12, 22, commonly known in the industry.

The previous detailed description is provided to enable any person skilled in the art to make or use the present cleaning, sanitizing, deodorizing and scale inhibiting solution. Various modifications to those embodiments will be readily apparent to those skilled in the art, and the generic principles defined herein may be applied to other embodiments without departing from the spirit or scope of the cleaning, sanitizing, deodorizing and scale inhibiting solution described herein. Thus, the present cleaning, sanitizing, deodorizing and scale inhibiting solution is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

TABLE 1

| | Solution Components | | | | | | Solution Characteristics | | |
|---|---|---|---|---|---|---|---|---|---|
| Example # | De-Ionized $H_2O$ (g) | 35% $H_2O_2$ (g) | 30% Ammonyx ® LO Surfactant (g) | 2% Sodium Stannate (g) | 10% Sodium Lauryl Sarcosinate (g) | 1% DTPMPA (g) | pH | Presence of Corrosion Indicators in three weeks? | $H_2O_2$ Stability? |
| 1 | 47.06 | 5.14 | 0.60 | 3.60 | 0.60 | 3.00 | 7.4 | No | Yes |
| 2 | 46.46 | 5.14 | 0.60 | 3.60 | 1.20 | 3.00 | 7.2 | No | Yes |

Example 1

As shown in Table 1, the following components were mixed together in a laboratory environment: 47.06 g of deionized water, 5.14 g of 35% hydrogen peroxide $H_2O_2$, 0.60 g of 30% Ammonyx® LO surfactant, 3.60 g of 2% solution of sodium stannate, 0.60 g of a 10% solution of sodium lauryl sarcosinate, 3.00 g of a 1% solution of diethylenetriamine penta(methylene phosphonic acid) chelating agent. The pH of this composition was 7.4.

Example one illustrates a cleaning and sanitizing solution that is stable and non-corrosive to copper and brass and is comprised of hydrogen peroxide, surfactant, chelating agent, stabilizer and corrosion inhibitor.

Example 2

As shown in Table 1, the following components were mixed together in a laboratory environment: 46.46 g of deionized water, 5.14 g of 35% hydrogen peroxide $H_2O_2$, 0.60 g of 30% Ammonyx® LO surfactant, 3.60 g of a 2% solution of sodium stannate, 1.20 g of a 10% solution of sodium lauryl sarcosinate, 3.00 g of a 1% solution of diethylenetriamine penta(methylene phosphonic acid) chelating agent. The pH of this composition was 7.2.

We claim:

1. A method of cleaning and sanitizing a porcelain urinal, the method comprising the steps of introducing a composition to the water stream supplying the urinal, the composition comprising:

a) about 90 wt % to about 99 wt % of water;

b) about 0.5 wt % to about 5 wt % of hydrogen peroxide;

c) about 0.1 wt % to about 1.5 wt % of amine oxide surfactant;

d) about 10 ppm by weight to about 0.5 wt % of stannate stabilizer;

e) about 10 ppm by weight to about 0.5 wt % of a chelating agent; and f) a corrosion inhibitor; and the composition has a pH of about 7.0 to about 9.0.

2. The method of claim 1, in which the corrosion inhibitor is selected from sodium molybdate at about 10 ppm by weight to about 0.5 wt %; sodium lauryl sarcosinate at about 0.05 wt % to about 0.2 wt %, sodium tolyltriazole at about 10 ppm by weight to about 0.5 wt %, and combinations thereof.

3. The method of claim 1, in which the chelating agent is DTPMPA.

4. A method of cleaning and sanitizing a porcelain toilet, the method comprising the steps of introducing a composition to the water stream supplying the toilet, the composition comprising:

a) about 90 wt % to about 99 wt % of water;

b) about 0.5 wt % to about 5 wt % of hydrogen peroxide;

c) about 0.1 wt % to about 1.5 wt % of amine oxide surfactant;

d) about 10 ppm by weight to about 0.5 wt % of stannate stabilizer;

e) about 10 ppm by weight to about 0.5 wt % of a chelating agent; and f) a corrosion inhibitor; and the composition has a pH of about 7.0 to about 9.0.

5. The method of claim 4, in which the corrosion inhibitor is selected from sodium molybdate at about 10 ppm by weight to about 0.5 wt %; sodium lauryl sarcosinate at about 0.05 wt % to about 0.2 wt %, sodium tolyltriazole at about 10 ppm by weight to about 0.5 wt %, and combinations thereof.

6. The method of claim 4, in which the chelating agent is DTPMPA.

* * * * *